US011910898B2

(12) United States Patent
Boninsegni

(10) Patent No.: US 11,910,898 B2
(45) Date of Patent: Feb. 27, 2024

(54) SUPPORT DEVICE FOR WHEELS OF TRANSPORTABLE CONTAINERS, SUCH AS TROLLEY CASES OR THE LIKE

(71) Applicant: Schedoni Luxury Goods Srl, Modena (IT)

(72) Inventor: Alessio Boninsegni, Modena (IT)

( * ) Notice: Subject to any disclaimer, the term of this patent is extended or adjusted under 35 U.S.C. 154(b) by 244 days.

(21) Appl. No.: 17/606,816

(22) PCT Filed: Apr. 29, 2020

(86) PCT No.: PCT/IB2020/054037

§ 371 (c)(1),
(2) Date: Oct. 27, 2021

(87) PCT Pub. No.: WO2020/222137

PCT Pub. Date: Nov. 5, 2020

(65) Prior Publication Data

US 2022/0202151 A1 Jun. 30, 2022

(30) Foreign Application Priority Data

Apr. 29, 2019 (IT) ..... 102019000006439

(51) Int. Cl.
*A45C 5/14* (2006.01)

(52) U.S. Cl.
CPC ..... *A45C 5/143* (2013.01); *A45C 2005/148* (2013.01)

(58) Field of Classification Search
CPC ..... A45C 5/143; A45C 2005/148; A45C 5/14; A45C 13/385; F16F 15/03; F16F 6/00; F16F 6/005; B60L 13/04; E05D 2015/0695; B60G 2600/22; B60G 2600/24; B60G 2600/26; B60B 19/006; B60B 2900/931
See application file for complete search history.

(56) References Cited

U.S. PATENT DOCUMENTS

2017/0334258 A1* 11/2017 Yang ..... B60B 33/0063
2018/0360183 A1 12/2018 Steinkraus
2021/0031561 A1* 2/2021 Langenfeld ..... G05D 1/0231

FOREIGN PATENT DOCUMENTS

CN 108968276 12/2018
CN 109203857 1/2019

* cited by examiner

*Primary Examiner* — Paul N Dickson
*Assistant Examiner* — Matthew D Lee
(74) *Attorney, Agent, or Firm* — Themis Law

(57) ABSTRACT

A support device for wheels of transportable containers, such as trolley cases or the like, has at least two parts fixed to each other, including a first and a second part, so that the two parts have a relative movement therebetween, from a condition of maximum approach to a condition of maximum distancing. The first part is integral with the container and the second part is formed by an arm adapted to support at least one wheel, rotatably fixed to the arm. Furthermore, the first and the second part each have at least one magnetic element, and the at least two magnetic elements are arranged in opposite positions so as to generate a magnetic force of repulsion between the two parts, aimed at permanently maintaining the two parts in a condition of maximum distancing.

9 Claims, 4 Drawing Sheets

SUPPORT DEVICE FOR WHEELS OF TRANSPORTABLE CONTAINERS, SUCH AS TROLLEY CASES OR THE LIKE

FIELD OF THE INVENTION

The present invention relates to a support device for wheels of transportable containers, such as trolley cases or the like, comprising at least two parts fixed to each other, of which a first and a second part, so that the two parts have relative movement therebetween, from a condition of maximum approach, to a condition of maximum distancing.

The first part is integral with the container, while the second part consists of an arm adapted to support at least one wheel, rotatably fixed to said arm.

The present invention relates in particular to the field of manufacture of travel containers such as suitcases, trolley cases and other luggage.

BACKGROUND OF THE INVENTION

Technological development has led to a continuous increase in the use of public transport, such as aeroplanes, trains or the like, for business or pleasure trips.

As a result, users are increasingly using transportable containers, such as trolley cases or the like, equipped with wheels for medium or long distance travel, even on not perfectly flat and sometimes uneven terrain, such as the pavements and footpaths of most cities.

Uneven floors and pavements are a particular hindrance to the sliding of the trolley case wheels, not only because they cause sudden stops of the wheels, but also and above all because of the vibrations transmitted to the user carrying the trolley case.

It is therefore of fundamental importance to create a device capable of absorbing the impacts transmitted to the wheels while they roll on uneven or disconnected surfaces, avoiding annoying transmissions of vibrations both to the user and to the sometimes fragile contents of the trolley case.

Furthermore, given the conditions of use, this device should consist of simple elements from a mechanical point of view and which have high resistance to wear and mechanical stress.

This device must also have features of lightness, a factor which is not always congruent with mechanical strength, as it must not contribute to an increase in user fatigue in carrying the trolley case, or to any boarding problems on planes/trains due to high weight.

Thus a need has not been met by the systems known to the state of the art to realize a suspension for the wheels of a transportable container such as a suitcase, trolley case or the like, which has mechanically simple components, easy to be assembled and maintaining an excellent compromise between weight and resistance to wear.

SUMMARY OF THE INVENTION

The present invention achieves the above objects by providing a support device for wheels of transportable containers as described above, wherein the first and the second part each have at least one magnetic element.

The at least two magnetic elements are arranged opposite so as to generate a magnetic force of repulsion between the two parts, aimed at keeping the two parts stably in a condition of maximum distancing therebetween.

A sort of trolley case suspension is therefore created which, unlike the provision of springs and shock absorbers such as the common suspensions, uses the magnetic force of the two magnetic elements to create the suspension effect.

According to this configuration, the suspension is simple from a constructive point of view and moreover the absence of mechanical parts, in addition to limiting the overall weight of the device object of the present invention, avoids breakages of the same due to the wear of the different mechanical parts which could interact, as in the common suspensions known to the state of the art.

Note that for the realization of the magnetic elements, magnets of any nature and any shape known to the state of the art can be used, provided they are arranged with their own magnetic poles so as to generate a force of repulsion that tends to distance the second part with respect to the first part.

Note also that the effect mechanically created by the magnets is not the cushioning effect but that of suspension, as shock absorbers must absorb the rebound/oscillation of the wheel and to do so they must absorb and dissipate the energy that is impressed or released by the suspension.

According to a possible embodiment, the first part and/or the second part have a seat for housing the magnetic element, which has insulating walls adapted to partially surround the magnetic element on all sides with the exception of the side facing the opposite magnetic element.

Since the wheels of the trolley case are in contact with the ground, the insulation of the magnetic element is a feature covering a particularly important aspect, as it prevents the magnetic elements from attracting metal objects that can be found on the ground, such as nails, screws, pins or metal scraps in general.

The magnetic element will therefore only have one "free" face, in particular the face facing the other magnetic element, so as to allow the generation of a force of repulsion between the two magnetic elements.

The correct identification of the value of the magnetic force of repulsion is a fundamental aspect: the contents of the trolley case associated with the device object of the present invention can in fact vary from a few hectograms to several kilograms.

In this situation managing to calibrate the force of repulsion so that the shock absorbing effect is adequate for such a wide range of values is particularly complex.

The device object of the present invention therefore provides various possible solutions, aimed at realizing systems for regulating the force of repulsion of the two magnetic elements.

According to a first embodiment, at least one elastic element is provided which is fixed to the first and the second part.

The elastic element can for example be constituted by a helical spring which can be fixed with the ends thereof to the first and the second part respectively.

In this case the force of repulsion between the first and the second part has two contributions, a magnetic contribution and an elastic contribution.

The elastic element is provided so that it can be removably fixed to the first and the second part, so that its contribution can be activated/deactivated as needed.

It will therefore be possible to provide magnets of a certain power, capable of supporting a certain weight of the contents of the trolley case, so that once this weight is exceeded, it is possible to maintain the cushioning effect by activating the contribution of the elastic element.

Alternatively, a second embodiment for adjusting the force of repulsion of the two magnetic elements provides for the use of means for adjusting the positioning of the magnetic elements.

It is clear that distancing/approaching one magnetic element with respect to another can decrease/increase the force of repulsion generated, thus it will be possible to adjust the cushioning effect based on the weight of the objects inserted inside the trolley case.

An embodiment shown below will describe the possible movement of the magnetic means in detail.

Alternatively or in combination with that which has been described above, with the aim of adjusting the force of repulsion between the two magnetic elements, it is possible to provide for modifying the strength of the magnetic elements.

For example, it is possible to provide replaceable magnetic elements, to be varied according to the weight of the objects in the container.

In this case, the device object of the present invention could provide seats for housing the magnetic elements on the first and the second part, together with sets of magnetic elements divided according to strength, which can be easily inserted/extracted from the housing seats.

As an alternative to this configuration, a solution, certainly more complex from the constructive point of view, but with greater ease of use, provides for the use of electromagnets as magnetic elements.

In this case it would be necessary to provide a current generation system, with a potentiometer, through which a user could control the intensity of current generated and consequently vary the strength of the magnetic elements.

According to a possible embodiment, the device object of the present invention comprises removable fixing means to the transportable container.

This configuration not only allows the wheels of the transportable container to be replaced in the event of breakage or replacement of the magnetic elements, but allows the device of the present invention to be adapted to transportable containers, such as trolley cases or the like, which do not have suspensions, making them cushioned.

As anticipated, the object of the present invention is to provide a device which allows to obtain a cushioning effect on a transportable container, i.e., to create a suspension that is robust, strong and light.

In order to achieve this purpose, in addition to the characteristics described above, it is clear that a careful study of the shape and construction of each individual component of the device itself is fundamental.

For this reason, the device object of the present invention provides embodiments of its components which do not follow simple constructive choices, but which represent the best compromise between weight, constructive simplicity, strength and ease of use.

According to an embodiment, in fact, the arm constituting the second part is hinged with an end thereof to the first part.

Advantageously, the second part consists of two plate-like elements pivoted to the first part.

In particular, the two plate-like elements are arranged on the sides of the wheel and parallel to the plane perpendicular to the axis of rotation of the wheel.

Furthermore, each plate-like element has at least a first hole for inserting a pin adapted to allow the rotation of the wheel and at least a second hole for inserting a pin configured to allow the hinging of the first part with the second part.

As will be clear from the illustrated embodiments, the plate-like element is therefore oscillating around the second pin.

In order to confer strength and prevent all the weight and handling from weighing down on the interface at the level of the second pin, it is possible to provide that each plate-like element has a sliding pin, which engages with a corresponding sliding groove provided on the first part, so that the sliding pin moves inside the sliding groove during the passage from the condition of maximum approach to the condition of maximum distancing and vice versa the first part with the second part.

Due to the presence of the pin and the sliding groove, the second part is fixed to the first part in two points, respectively at the level of the second pin and at the level of the sliding groove.

Finally, note that to improve the compactness of the entire device, while maintaining the functionalities unchanged, preferably the magnetic element of the second part is inserted between the two plate-like elements.

Given the advantageous aspects described above, the present invention also relates to a transportable container such as a trolley case, suitcase or the like, comprising a support device for wheels of transportable containers.

The support device is in this case realized according to one or more of the characteristics described above.

BRIEF DESCRIPTION OF THE DRAWINGS

These and other features and advantages of the present invention will become clearer from the following description of some exemplary embodiments illustrated in the attached drawings wherein.

DETAILED DESCRIPTION OF EMBODIMENTS OF THE INVENTION

It is specified that the figures attached to the present description show some preferred embodiments of the support element object of the present invention to better understand its advantages and features described.

These embodiments are therefore to be understood for purely illustrative and non-limiting purposes of the inventive concept of the present invention, namely that of realizing a suspension for a transportable container of the trolley case type, which is strong, robust and light and which allows optimally cushioning the transportable container.

Figure 1:
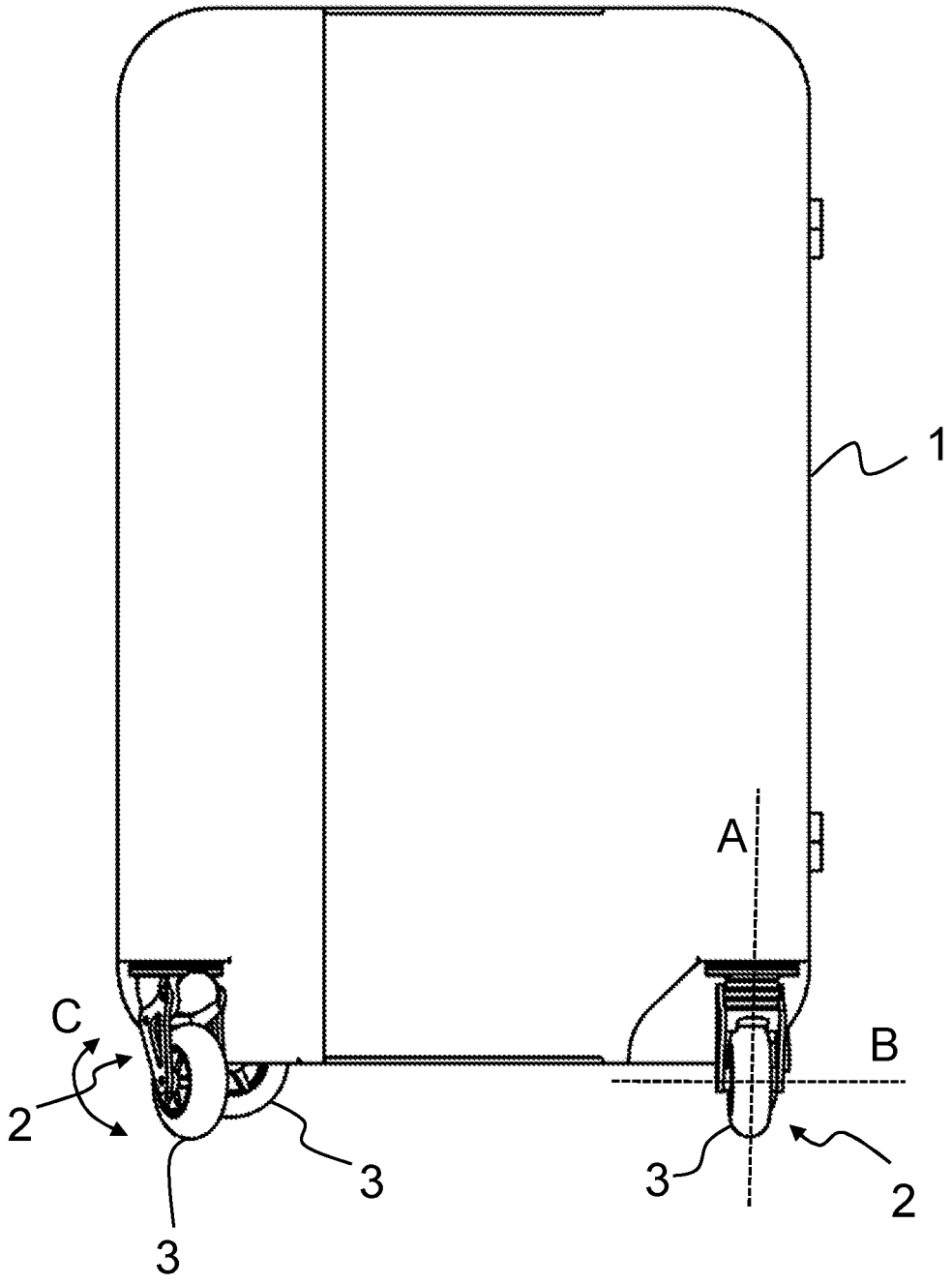
FIG. 1 shows a view of a transportable container on which the device object of the present invention is fixed.

In particular, FIG. 1 shows a transportable container, i.e., a trolley case 1, which has four wheels 3.

At least one of the wheels 3, preferably two of the wheels 3, are supported by a support device 2 which allows the rolling of the wheels 3 around the axis B and the rotation of the wheels around the axis A, so as to facilitate the movement of the trolley case 1.

Furthermore, the support device 2 is configured so as to allow a suspension of the wheels 3, i.e., a movement of the wheels 3 in the direction of the trolley case 1, in the directions indicated by the arrow C.

Figure 2:
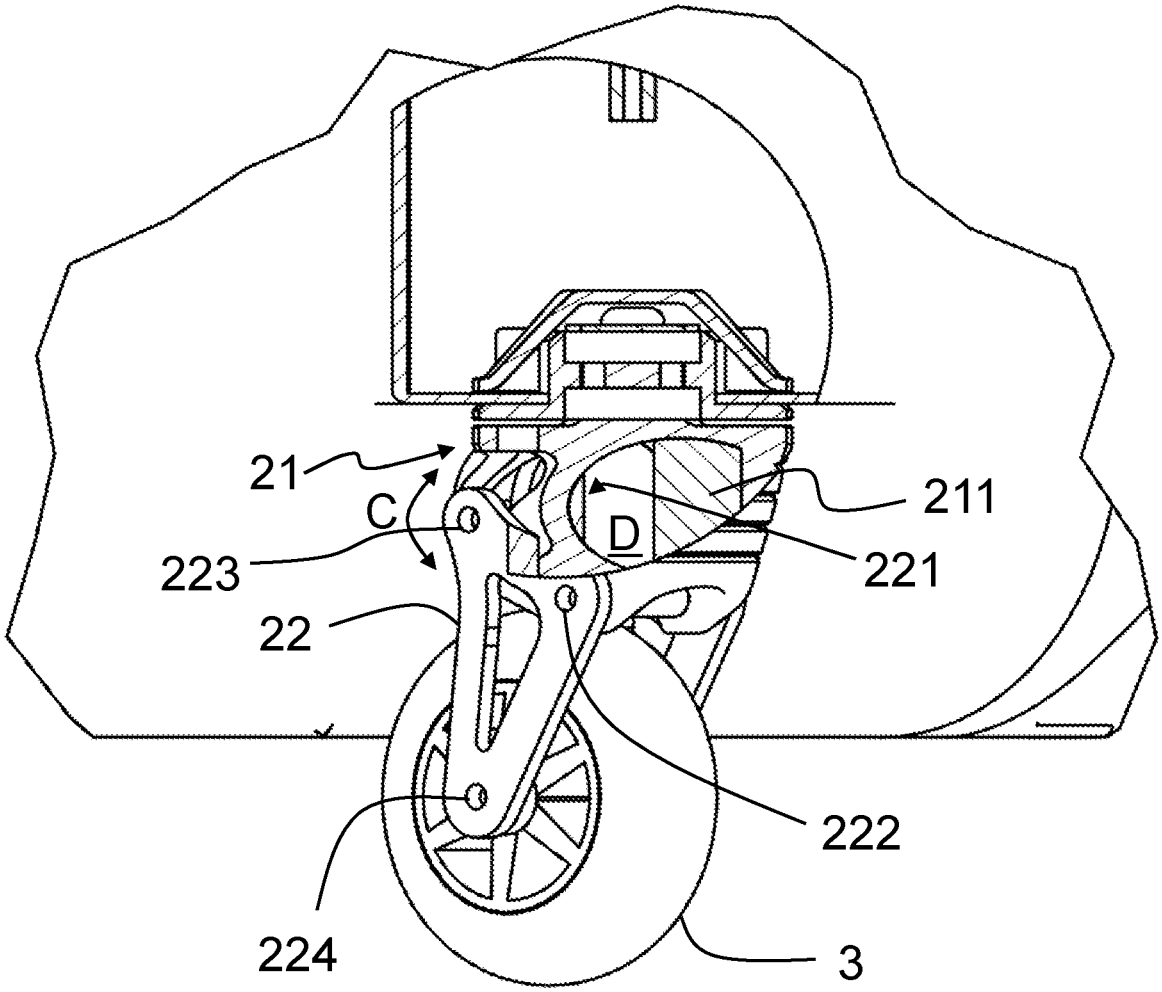
FIG. 2 shows a perspective view of the device object of the present invention.
Figure 3:
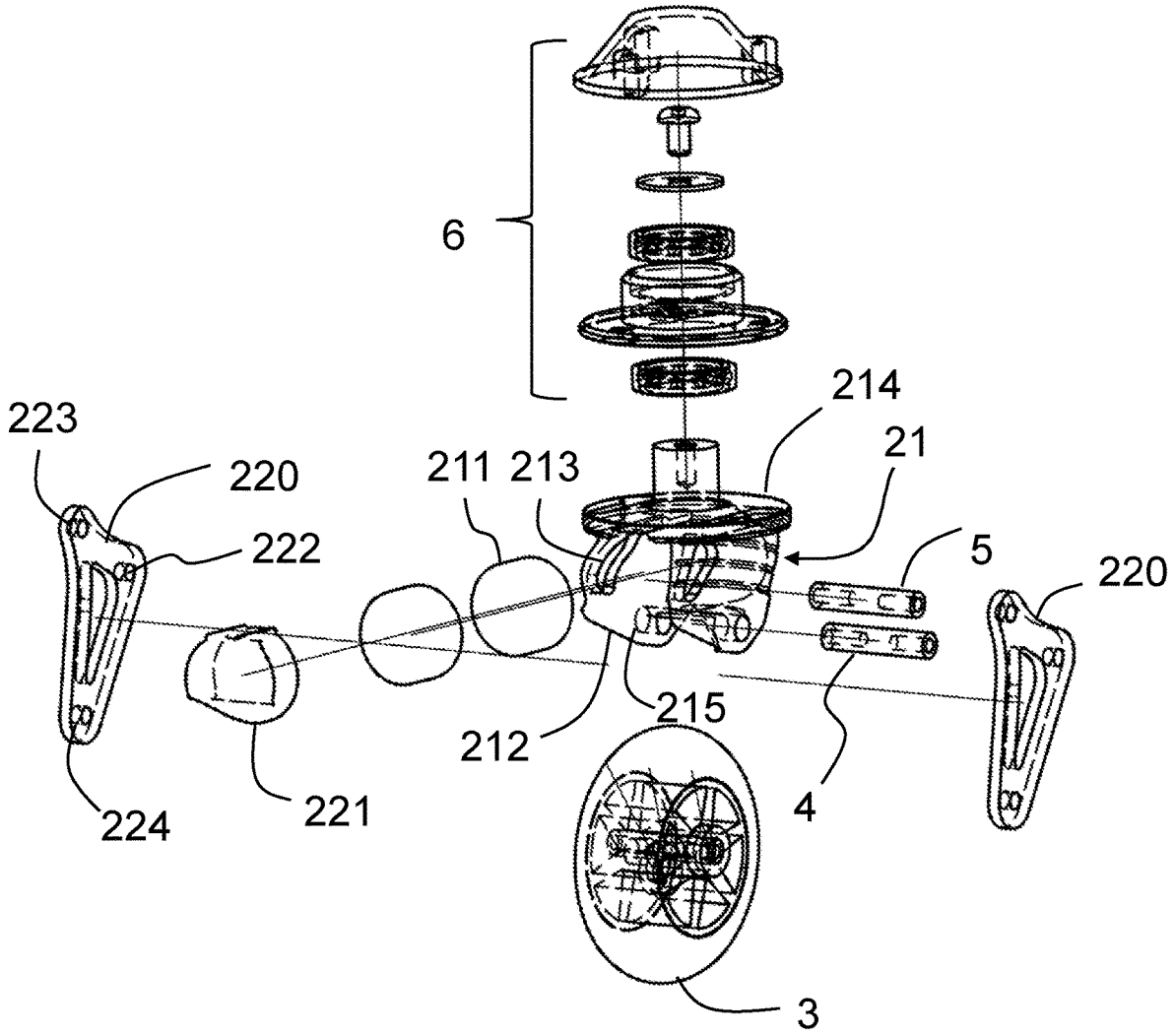
FIG. 3 shows an exploded view of the device object of the present invention.

The support device 2 is shown in particular in FIGS. 2 and 3 and comprises at least two parts 21 and 22, fixed to each other, of which a second part 22 which has a relative movement with respect to a first part 21, integral with the trolley case 1.

It is clear that the first part 21 is integral with the trolley case 1 in the sense that it has no translations with respect to this trolley case, however it can rotate around a vertical axis.

In fact, although the second part 22 has a relative movement with respect to the first part 21, both parts, together with the wheel 3, are pivoting with respect to the trolley case 1.

As will be described later, during movement, the second part 22 passes from a condition of maximum approach, FIG. 4*a*, to a condition of maximum distancing, FIG. 4*b*, with respect to the first part 21.

With particular reference to FIG. 2, both the first part 21 and the second part 22 have a magnetic element, respectively 211 and 221, the two magnetic elements are arranged opposite so as to generate a magnetic force of repulsion between the two parts 21 and 22, aimed at permanently maintaining the two parts and 22 in a condition of maximum distancing therebetween.

With particular reference to FIG. 2, the magnetic element 211 is integral with the first part 21, while the magnetic element 221 is integral with the second part 22.

Figure 4A:
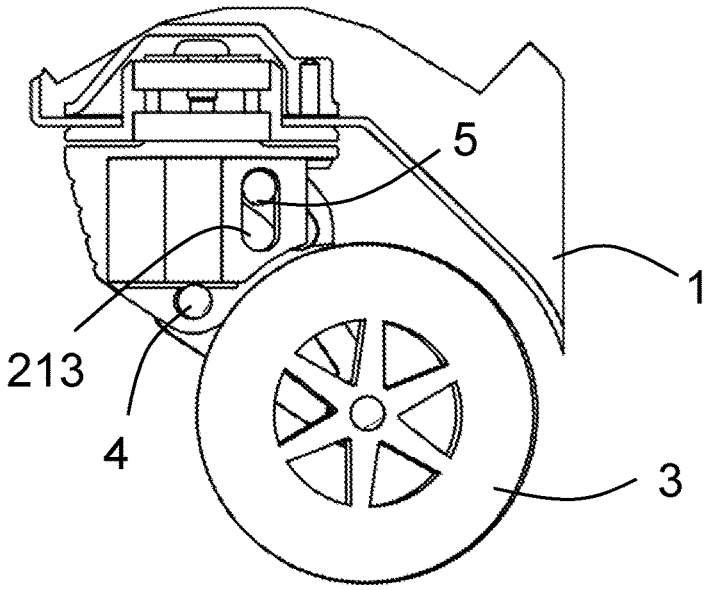
FIGS. 4*a* and 4*b* show two views of the device object of the present invention, in particular with the first part and the second part in the condition of maximum and minimum approach.
Figure 4B:
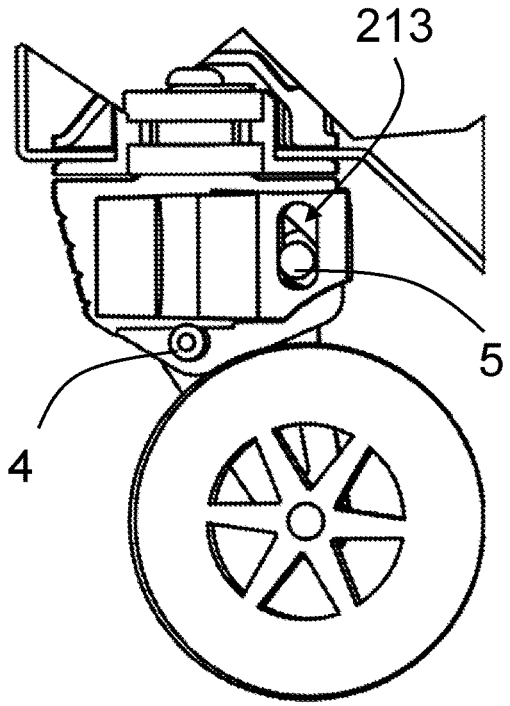

In the space D identified by the two magnetic elements 211 and 221, the latter have the opposite poles facing each other, so as to create a force that tends to distance the second part 22 from the first part 21, pushing the second part 22 to the left, with reference to FIG. 2 and towards the condition of maximum distancing, FIGS. 2 and 4*b*.

The two magnetic elements 211 and 221 are preferably constituted by "pad" elements, as shown in FIG. 3, and can be inserted inside the first 21 and the second part 22 through special housing seats.

These housing seats, not shown in the figure, can have side walls for insulating the magnetic elements 211 and 221, i.e., walls covering the faces of the magnetic elements 211 and 221, with the exception of the face facing the space D of FIG. 2.

As shown in FIG. 3, the first part 21 consists of a single body which has an upper wall 214 from which two lateral walls 212 extend which identify a space inside which the wheel 3 is partially housed with the upper part thereof.

As shown in FIG. 3, the upper wall 214 has fixing means 6 to the trolley case 1.

These fixing means can be realized in one of any known ways in the state of the art, for example through fixing screws which are inserted in special seats provided on the upper wall 214.

Still with reference to FIG. 3, the second part 22 consists of two plate-like elements 220 pivoted to the first part 21 and arranged on the sides of the wheel 3, so as to be parallel to the plane perpendicular to the axis of rotation of the wheel 3.

Each plate-like element 220 is fixed to a corresponding side wall 212 belonging to the first part 21.

In particular, each plate-like element 220 has a hole 222 which, in the assembled condition, is superimposed on the hole 215 of the corresponding side wall, so that the plate-like elements 220 can be fixed to the side walls 212 through the pin 4.

The pin 4 is inserted inside the holes 222 and 215 so as to allow the plate-like elements 220 to oscillate with respect to the first part 21 in the direction indicated by the arrow C of FIG. 2.

Each plate-like element 220 further comprises a hole 224 for the rotation fixing of the wheel 3, for example through a pin, as in the known systems of the state of the art.

Furthermore, the side walls 212 have a sliding groove 213, while the plate-like elements 220 have a further hole 223.

In the assembled condition, the holes 223 are superimposed on the sliding grooves 213, so as to allow the insertion of a sliding pin 5.

The pin 4 is therefore coaxial with the holes 222 of the plate-like elements 220 and inserted inside the holes 215 of the side walls 212, while the pin 5 is coaxial with the holes 223 of the plate-like elements 220 and inserted inside the sliding grooves 213 of the side walls 212.

On the basis of the embodiment of FIG. 3, moreover, the magnetic elements 211 and 221 are placed inside the space between the two plate-like elements 220 in the assembled condition and on planes parallel to each other and perpendicular to the planes of the plate-like elements 220.

According to this configuration, during the passage from the condition of maximum approach to the condition of maximum distancing of the first part 21 with respect to the second part 22, the plate-like elements 220 oscillate around an axis of rotation placed at the longitudinal axis of the pin 4, while the pin 5 moves integrally with the plate-like elements 220 by sliding along the sliding grooves 213 of the side walls 212.

This situation is clearly shown in FIGS. 4*a* and 4*b*.

In FIG. 4*a* the first part 21 is in the condition of maximum approach to the second part 22.

The oscillation of the second part 22 with respect to the first part 21 in fact allows to move the wheel 3 in the direction of the container 1, the sliding pin 5 is in the other most part of the sliding groove 213.

For example, if during rolling the wheel 3 encounters an obstacle or a hole, the movement of the second part 22 with respect to the first part 21 would allow cushioning this obstacle or the hole, facilitating the rolling of the wheel 3.

Once the obstacle has been overcome, the presence of the magnetic elements 211 and 221, described above, generates a force of repulsion which tends to distance the second part 22 from the first part 21: the sliding pin 5 slides along the sliding groove 213 until reaching the lowest point, shown in FIG. 4*b*, corresponding to the condition of maximum distancing, or minimum approach, between the two parts 21 and 22 and consequently between the wheel 3 and the trolley case 1.

FIGS. 4*a* and 4*b* clearly show two end-stroke conditions of the sliding pin 5, which is stably in the condition shown in FIG. 4*b*, thanks to the force of repulsion generated by the two magnetic elements 211 and 221.

During the rolling of the wheels, the sliding pin will move along the sliding groove 213, and consequently the second part 22 will oscillate with respect to the first part 21, based on the interaction between the magnetic force of repulsion and the forces acting on the trolley case, generated by a combination of the weight of the trolley case and its contents, the impact of the wheels and the pushes of a possible user.

While the invention is susceptible to various modifications and alternative constructions, some preferred embodiments have been shown in the drawings and described in detail.

It must be understood, however, that there is no intention to limit the invention to the specific embodiment shown, but, on the contrary, it intends to cover all the modifications, alternative constructions, and equivalents that fall within the scope of the invention as defined in the claims.

The use of "for example", "etc.", "or" indicates non-exclusive alternatives without limitation unless otherwise indicated.

The use of "includes" means "includes, but not limited to" unless otherwise indicated.

The invention claimed is:

1. A support device for wheels of transportable containers, comprising:

two parts fixed to each other, said two parts comprising a first and a second part, so that said two parts have a relative movement therebetween, from a condition of maximum approach, to a condition of maximum distancing, said first part being integral with a container and said second part defining an arm adapted to support at least one wheel, rotatably fixed to said arm, wherein said first and said second parts each have a magnetic element, thereby providing two magnetic elements arranged opposite so as to generate a magnetic force of repulsion between said two parts, aimed at permanently maintaining said two parts in a condition of maximum distancing therebetween, further comprising at least one elastic element fixed to one or both of the first or the second part.

2. The device according to claim 1, wherein one or both of said first part and said second part have a housing seat for housing said magnetic element, and wherein the housing seat has insulating walls adapted to partially surround said magnetic element on all sides except for a side facing the opposite magnetic element.

3. The device according to claim 1, wherein said arm is hinged with an end thereof to said first part.

4. The device according to claim 1, further comprising removable fixing means to said transportable container.

5. The device according to claim 1, further comprising means for adjusting a positioning of said two magnetic elements.

6. The device according to claim 1, wherein said second part is composed of two plate-shaped elements pivoted to said first part, the two plate-shaped elements being arranged on sides of said wheel and parallel to a plane perpendicular to an axis of rotation of the wheel, each plate-shaped element having at least a first hole for inserting a first pin adapted to allow a rotation of said wheel and at least a second hole for inserting a second pin configured to allow a hinging of said first part with said second part.

7. A support device for wheels of transportable containers, comprising:

two parts fixed to each other, said two parts comprising a first and a second part, so that said two parts have a relative movement therebetween, from a condition of maximum approach, to a condition of maximum distancing, said first part being integral with a container and said second part defining an arm adapted to support at least one wheel, rotatably fixed to said arm, wherein said first and said second parts each have a magnetic element, thereby providing two magnetic elements arranged opposite so as to generate a magnetic force of repulsion between said two parts, aimed at permanently maintaining said two parts in a condition of maximum distancing therebetween, wherein said second part is composed of two plate-shaped elements pivoted to said first part, the two plate-shaped elements being arranged on sides of said wheel and parallel to a plane perpendicular to an axis of rotation of the wheel, each plate-shaped element having at least a first hole for inserting a first pin adapted to allow a rotation of said wheel and at least a second hole for inserting a second pin configured to allow a hinging of said first part with said second part, wherein each plate-shaped element has a sliding pin, and wherein the sliding pin engages a corresponding sliding groove provided on the first part, so that said sliding pin moves inside said sliding groove during a passage from a maximum approach condition to the maximum distancing condition and vice versa.

8. The device according to claim 6, wherein the magnetic element of the second part is inserted between said two plate-shaped elements.

9. A transportable container comprising:

a support device for wheels of transportable containers according to claim 1.

* * * * *